United States Patent [19]

Friedman

[11] Patent Number: 4,782,676

[45] Date of Patent: Nov. 8, 1988

[54] PUZZLE LOCK

[76] Inventor: Ira Friedman, 12815 Guildford Cir., West Palm Beach, Fla. 33414

[21] Appl. No.: 105,098

[22] Filed: Oct. 5, 1987

[51] Int. Cl.[4] ..... E05B 37/20

[52] U.S. Cl. ..... 70/289; 70/288; 70/298

[58] Field of Search ..... 70/289, 290, 287, 288, 70/297, 298; 273/153 R, 153 S

[56] References Cited

U.S. PATENT DOCUMENTS

| | | | |
|---|---|---|---|
| 707,381 | 8/1902 | Bos | 70/289 |
| 933,432 | 9/1909 | Guerry | 70/289 |
| 3,260,079 | 7/1966 | Caskey | 70/289 |
| 4,548,410 | 10/1985 | Morrone | 273/153 S |

FOREIGN PATENT DOCUMENTS

| | | | |
|---|---|---|---|
| 2563265 | 10/1985 | France | 70/290 |

*Primary Examiner*—Robert L. Wolfe

*Attorney, Agent, or Firm*—Wolf, Greenfield & Sacks

[57] ABSTRACT

A device that may be embodied either as an interlocking puzzle game or as a security device and formed of a body and associated locking member adapted to be received by the body. A plurality of combination blocks are supported in the body along with a plurality of keys. The blocks have slots for receiving the keys with each key having a locked position and an unlocked position. The key in the locked position engages the locking member to prevent disengagement thereof from the body. The key in the unlocked position is disposed in the block and out of engagement with a locking member to enable disengagement thereof from the body. The combination blocks may be rotatable in the body.

35 Claims, 6 Drawing Sheets

12
14
11
24
3
40A
10
39
31
52
40
2
36
30
34
36A
36B
20
50
16
18
47
46
23
42
38
41
37

40
47
52
33
35
34
36
23
10
20
16
22
14
50
18
46
30
38
39
32
37

Fig. 5
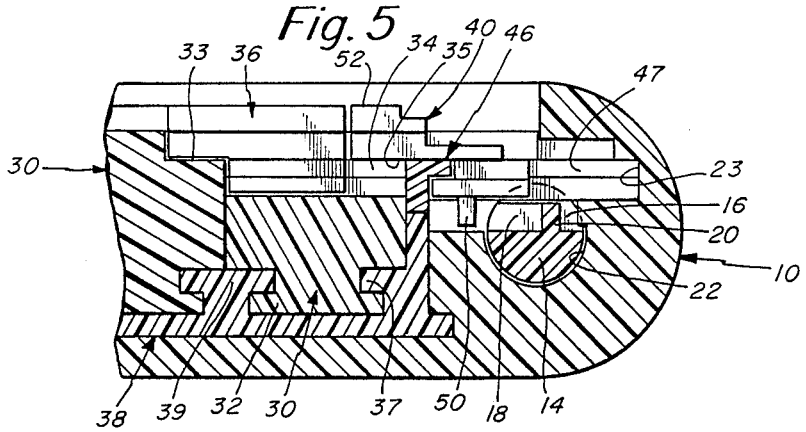
Fig. 6
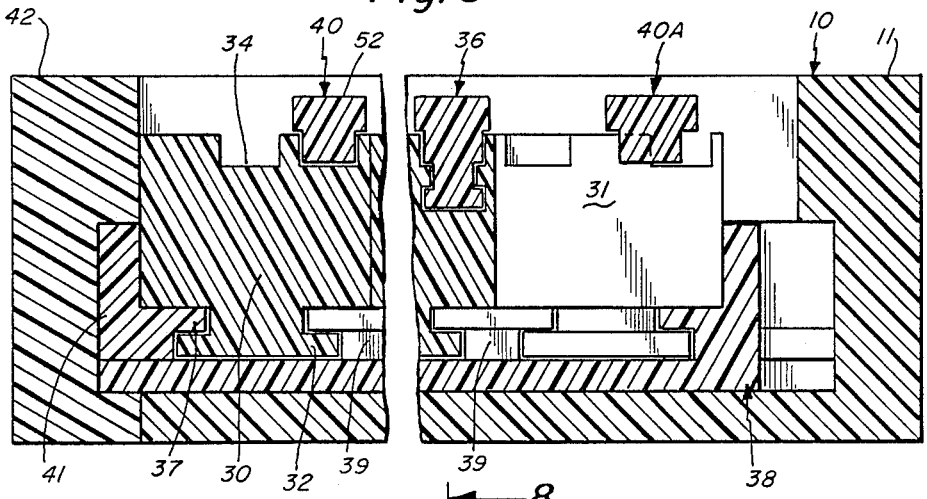
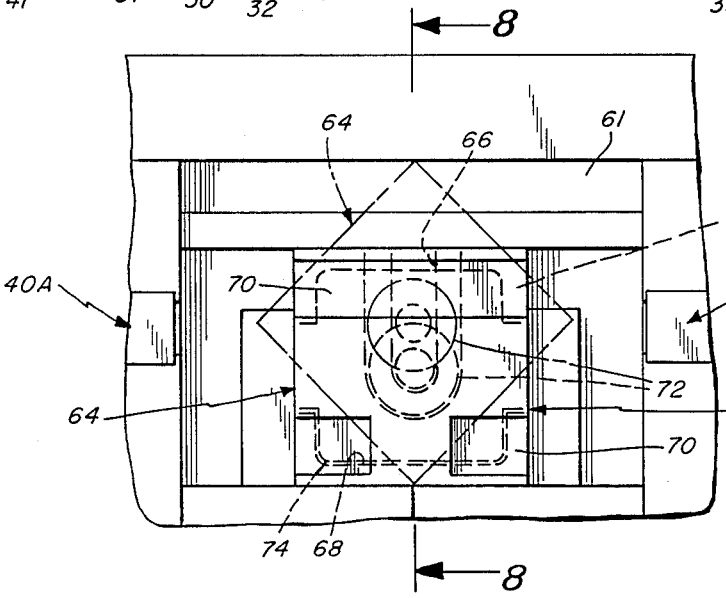
Fig. 7

Fig. 8
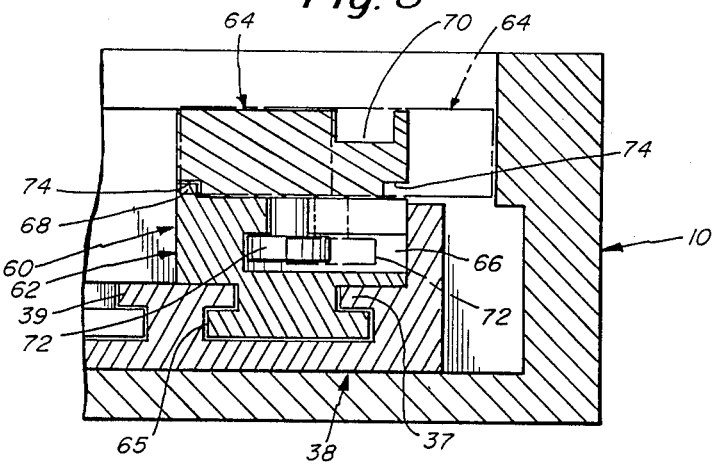
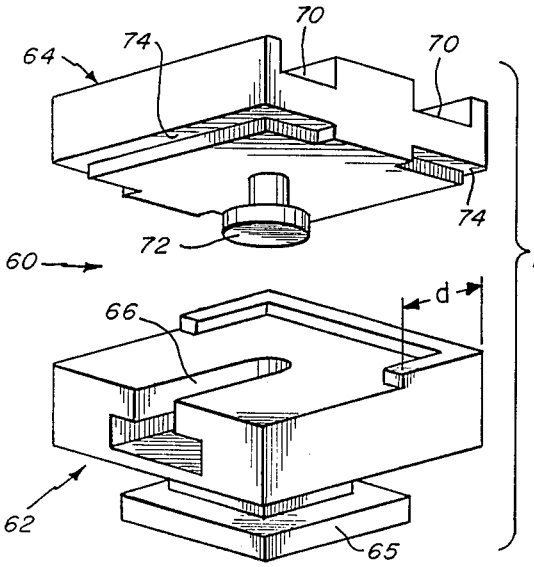
Fig. 9
Fig. 10
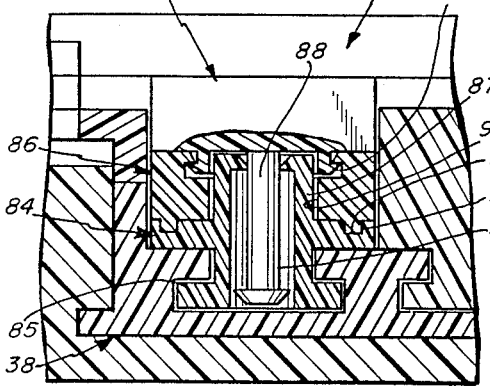
Fig. 11
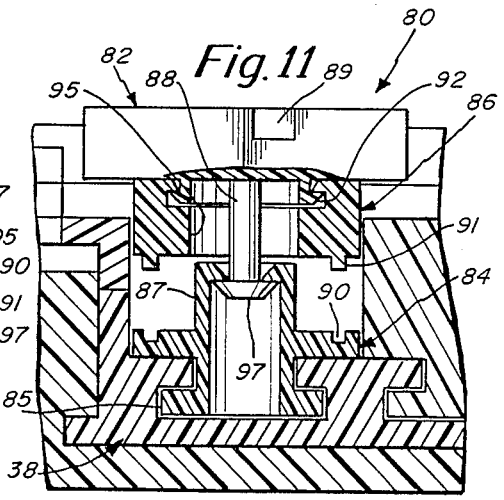

PUZZLE LOCK

BACKGROUND OF THE INVENTION

1. Field of the Invention

The present invention relates in general to a puzzle lock. More particularly, the invention pertains to an apparatus that may be embodied as a puzzle or game or alternatively may be used as an actual security device in the form of a mechanical lock. Even more particularly, the present invention relates to a combination lock which may be set and opened by means of a mechanical puzzle arrangement.

2. Objectives of the Invention

One object of the present invention relates to a combination lock that is both set and opened by means of a mechanical puzzle.

Another object of the present invention is to provide a combination lock in which a key or a memorized combination are not needed to open the lock.

A further object of the present invention is to provide a puzzle lock that may be embodied either as an intellectual game or puzzle or as an actual security device.

Still another object of the present invention is to provide a combination lock as identified previously, as in accordance with the preceeding objects, and which is readily adapted to be played at different skill and intelligence levels.

Still a further object of the present invention is to provide a combination lock embodied in a mechanical puzzle and which is relatively simple in construction, inexpensive to manufacture and which is essentially maintenance free.

SUMMARY OF THE INVENTION

To accomplish the foregoing and other objects, features and advantages of the invention there is provided an interlocking puzzle game that may also be embodied as an actual mechanical lock and which is comprised of a body and a locking member which is received by the body. The locking member may be in the form of a shackle having a pair of arms each with separate locking ribs. The body may have spaced elongated passages for receiving the shackle arms. There are also provided a plurality of combination blocks fitted in the body and adapted to cooperate with a plurality of keys also supported in the body in sliding relationship and disposed adjacent the combination blocks. In the disclosed embodiment there are two sets of keys held in respective key support members with each set being adjacent one of the arms of the locking member.

The aforementioned combination blocks each have means for receiving a key. In the embodiment disclosed, each block has at least one slot for receiving a key and in the majority of the blocks there are a plurality of slots for receiving respective keys. In the disclosed embodiment each block may have three slots relating to three separate keys. Each of the keys have at least a locked position and an unlocked position. The key in its locked position engages the locking member to prevent disengagement thereof from the body. The key in the unlocked position is disposed in the block and out of engagement with the locking member to enable disengagement thereof from the body. Each key, in its locked position engages with locking ribs on the shackle arm. Each arm preferably also has an elongated recess with each key (except the safety keys) also having a neutral position in which it may be disposed and in which it engages the elongated recess.

To provide further complication for a user of the game, there are a number of other features that are preferably incorporated into the device of this invention. A slider may be disposed in the slot of a block. This slider may be shorter or the same in length as the length of the slot and may be disposed in different positions in the slot. To solve the puzzle it may be required that, not only the blocks be moved to the proper position in the body but also that the slider be moved to one or the alternate positions for proper interlocking of keys with block slots.

The combination blocks may also be carried in a carriage that is disposed in the body and that may be slid between alternate positions. The carriage has at least two alternate positions to provide different interengagement patterns between the blocks and keys. With respect to the blocks themselves, they are supported in the body, or in the carriage, in a manner which permits the blocks to slide around the body so that different blocks may be slid to align with the keys. The blocks are slid into different patterns so that slots therein can align with corresponding selected keys. Once the key is inserted into a slot into the block then this releases that particular locking rib. When all locked keys can be moved to their unlocked position, then the locking member may be removed from the body and the puzzle is solved or alternatively, the lock is unlocked.

For further complexity in accordance with the invention, each of the blocks may be constructed in a form, in which the block is not only slidable about the body through the block array but is also rotatable. In this regard the block may have a non-rotatable base and a rotatable top piece supported over the base. The top piece may be capable of rotation through say 180°. Alternatively, the block could also be rotated through 90° in which case there would have to be a combination for slots on all four faces of the block. In an alternate embodiment of the invention the block may also include an intermediate piece and the top piece is adapted in this embodiment for lifting relative to the base to enable rotation thereof. In the first embodiment of the rotatable block, the block is rotatable only in predetermined positions in the array while in the second embodiment the block can be rotated in any position in the array.

BRIEF DESCRIPTION OF THE DRAWINGS

Numerous other objects, features and advantages of the invention should now become apparent upon a reading of the following detailed description taken in conjunction with the accompanying drawings, in which :

FIG. 5 is an enlarged cross-sectional view similar to that illustrated in FIG. 2 but for the unlocked position illustrating the key disengaged from the shackle locking ribs;

FIG. 6 is a cross-sectional view taken along line 6—6 of FIG. 4; ,

FIG. 7 is a fragmentary plan view of an alternate construction of a combination block in which the block is rotatable and in which it is illustrated in FIG. 7 in its partially rotated position;

FIG. 8 is a cross-sectional view taken along line 8—8 of FIG. 7 showing further detailed construction of the rotatable combination block;

FIG.9 is an exploded perspective view of the block of FIGS. 7 and 8;

FIG. 10 is a fragmentary cross-sectional view of an alternate combination block construction in which the block is of three piece construction;

FIG. 11 is a fragmentary cross-sectional view similar to that illustrated in FIG. 10 illustrating the top part of the block being lifted for enabling rotation thereof;

DETAILED DESCRIPTION

Figure 1:
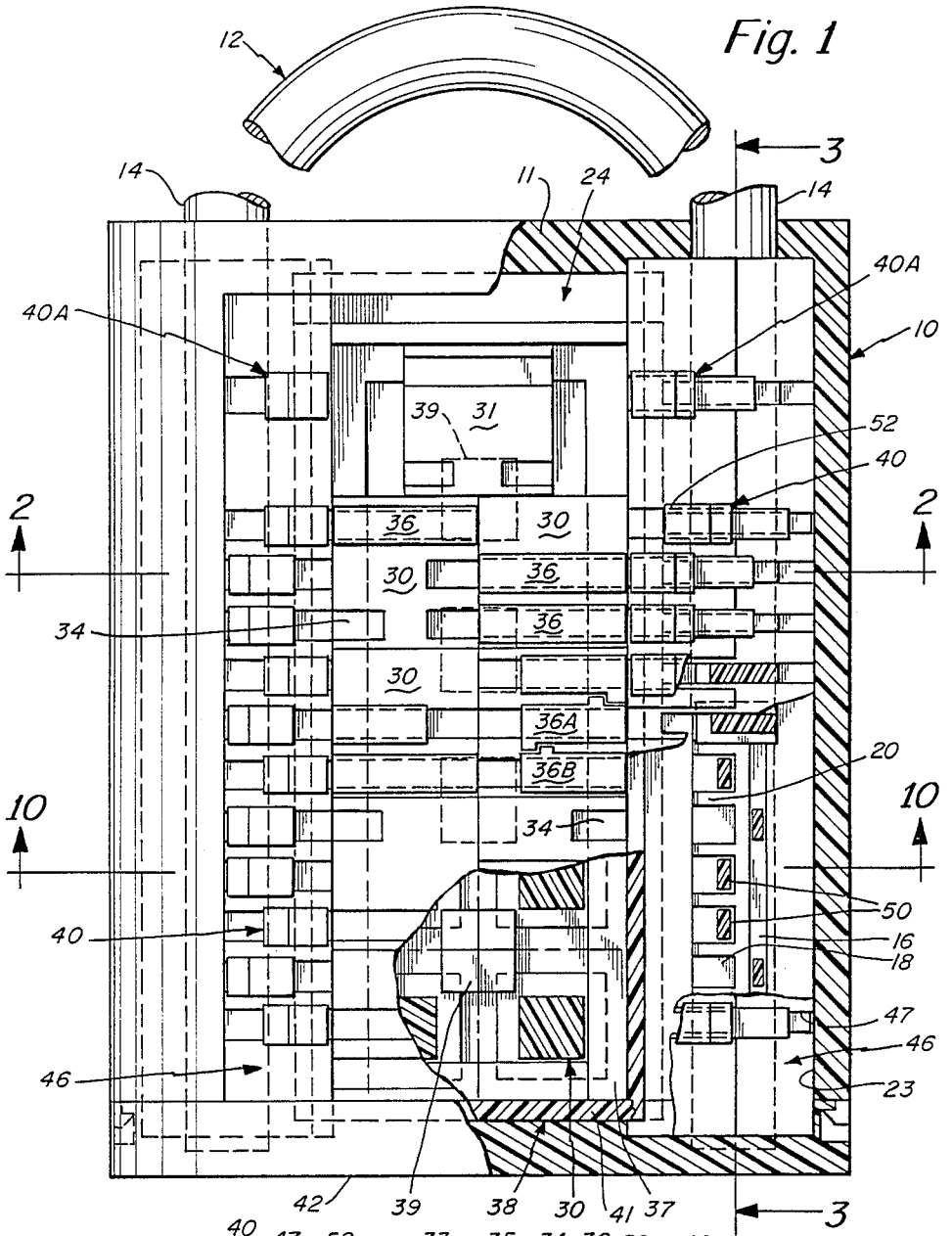
FIG. 1 is a plan view partially cut away and illustrating a preferred embodiment of the puzzle lock of this invention.

The present invention is illustrated in a preferred embodiment in the drawings herein. The drawings also illustrate alternate combination block constructions. It is noted that, in accordance with the invention, neither a key nor a memorized combination are needed to open the lock. In essence, there are numerous combinations and sequences that may be employed. Once all of the selected keys have been interlocked properly with their corresponding blocks then the puzzle is solved. The puzzle lock of the present invention may be used either as an intellectual game or puzzle or can be used as an actual security device. Furthermore, the puzzle lock of the present invention may be constructed in different forms so as to provide different levels of difficulty in solving the device. The complexity of the device as far as solving the puzzle is concerned is enhanced by furthermore providing the blocks in a carriage that may be moved between at least two alternate positions and by furthermore providing rotatable blocks.

Now to the specific embodiment described herein, there is disclosed a body 10 which is adapted to receive the various other components comprising the puzzle lock. All of these various components may be constructed of a plastic material. A locking member 12 is adapted to engage with the body. The locking member 12 may be in the form of a shackle having opposite arms 14. Each arm 14 has an elongated slot 16 and is also provided with a series of separate recesses 18 formed by separate ribs 20. The arms 14 of the shackle 12 are received in elongated passages 22 in the body 10. In this regard, refer to FIG. 13 for an illustration of the passages 22 with the shackle 12 illustrated separated from the body and in position to be inserted into the passages 22. The keys, to be described in further detail hereinafter, are in a neutral position when in the slot 16, are in a locked position when in the recess 18 and are unlocked when moved out of the recess 18.

Figure 13:
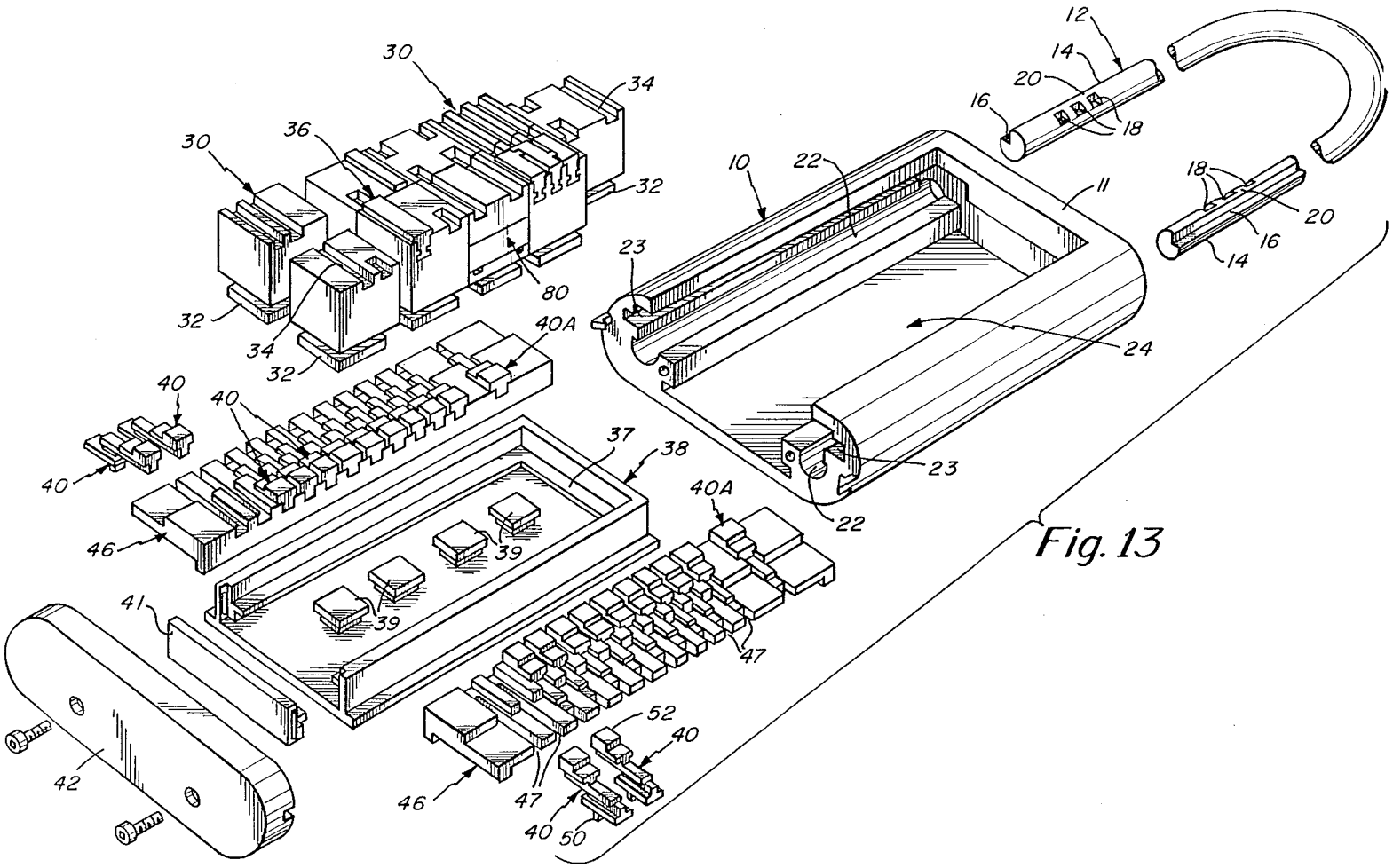
FIG 13 is an exploded perspective view of the overall puzzle lock with all components.

As illustrated in FIG. 13, the body 10 is open in its central area 24 and is configured to receive the combination blocks 30. In this connection, in FIGS. 1, 2 and 13, it is noted that the blocks 30 are of solid construction and are of an embodiment in which they are not rotatable. Other rotatable embodiments are to be described hereinafter.

In the particular embodiment described herein, there are a total of nine blocks 30. In other embodiments different numbers of blocks may be used and they may be disposed in different predetermined arrays. To enable the blocks to be moved about the general array configuration, there is essentially spacing for ten blocks but only nine blocks are used so that the blocks can be rotated about the array from space to space. In this connection, it is noted in FIG. 1 that eight of the blocks are disposed side-by-side in a fixed array and a ninth block is disposed thereabove. This is illustrated as block 31 in FIG. 1.

Each of the blocks 30 has a base 32 and is furthermore provided with one or more slots 34 that may be of different length as illustrated in, for example, FIGS. 1 and 13. These slots 34 are disposed in the top face of each of the blocks 30 and are adapted to be positioned for alignment with corresponding keys 40. Refer, for example, to FIG. 13 and the single key 40 illustrated.

Figure 2:
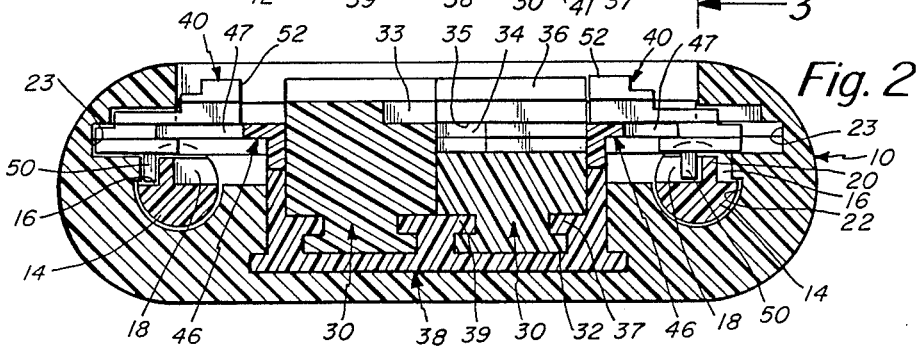
FIG. 2 is a cross-sectional view taken along line 2—2 of FIG. 1.
Figure 3:
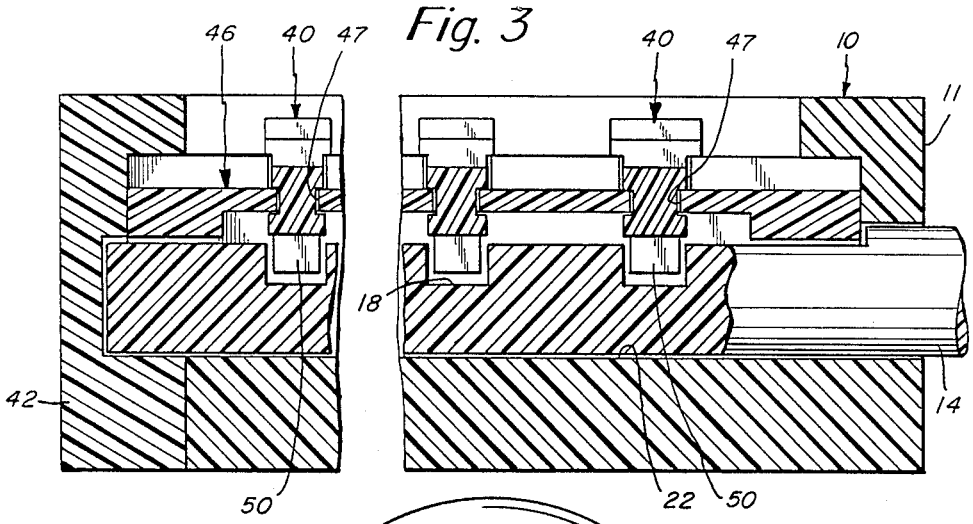
FIG. 3 is a cross-section view taken along line 3—3 of FIG. 1.

The aforementioned slots 34 are provided as a means for receiving certain keys. In addition, the slots 34 may carry sliders such as the slider 36 illustrated in FIG. 13. Also, a number of different sliders are illustrated in FIG. 1. FIG. 2 also shows a slider 36 which is undercut at 35 so that the slider may move to the left and partially into the adjacent slot at 41 in the adjacent block 30 such as is illustrated in FIG. 2.

FIG. 1 also illustrates a further interrelationship between adjacent sliders. This is illustrated in FIG. 1 at sliders 36A and 36B. It is noted that these sliders may be provided with tab and slot arrangements as illustrated in this plan view so that the movement of one slider causes a corresponding movement of another slider. This provides for a further challenge to the user.

It is furthermore noted, from FIG. 1 that some of these sliders may be of the full width of a block 30 while others are usually of about two-third of the width of the block or the length of the slot. Thus, the sliders 36 can be moved in the slot from side to side to provide an accomodating slot on either side thereof depending upon the position of the block relative to a key.

In the embodiment described herein, the blocks 30 are supported in a retainer, also referred to herein as a carriage and illustrated, for example, FIG. 13 as the carriage 38. This carriage 38 receives all nine of the blocks 30. To control the displacement of the blocks about the carriage 38 there are provided four guide posts 39. A cross-sectional view such as is illustrated in FIG. 2 clearly shows the manner in which the blocks 30 interlock with the guide posts 30 as well as the peripheral lip 37.

As illustrated in FIG. 13, one end of the carriage 38 is closed by the end wall 41. The end wall 41 may snap fit into the carriage 41. The end wall 41 may be removed for replacement of a certain one or more of the blocks 30.

The carriage 38 as illustrated in FIG. 13, may be moved between two separate longitudinally displaced positions thus also displacing the block supported therein between two separate positions. One position is illustrated in FIG. 1 in which the carriage is disposed against the base 42. The other alternate position is one in which the carriage 38 may be moved upwardly in the view of FIG. 1 so that the top of the carriage is against the end wall 11 of the body. This longitudinal displacement of the carriage is by an amount equal to the spacing between adjacent keys. The carriage is to be moved by an amount so that keys align properly with slots in the blocks.

Reference has been made hereinbefore to the plurality of keys 40. These keys are supported by a pair of key support members 46 also illustrated in FIG. 13. Each of the members 46 is provided with a plurality of slots 47 for providing sliding mounting of a corresponding key 40. The keys 40 as well as the key support members 46 are disposed in the body 10. In this connection, note in FIG. 13 that the body is provided with elongated slots at 23 with which the key support members 46 engage. The innermost portion of the key support member, as illustrated in FIG. 2, for example, rests upon the peripheral wall of the carriage 38 along the sides thereof.

Each of the keys 40, as described previously, is adapted to be moved in a slot 47 of the key support member 46. Each of the keys 40 includes a downwardly depending leg 50 that is the portion of the key that is adapted to interlock with the recess 18 in the shackle 12. The key 40 also includes interlocking end 52 that is the end that is adapted to slide into a slot in the block 30.

In FIGS. 1 and 2 the keys 40 are shown in one of two positions, either the "locked" position or the "neutral" position. The neutral position is illustrated to the left in FIG. 2 in which the depending leg 50 is disposed in the slot 16 of the shackle 12. The key 40 is thus prevented once the shackle is inserted into the body, from moving out of this "neutral" position. This simply means that this particular key is not one that is selected for engagement with a block or not part of this combination.

On the other hand, in the right hand side of FIG. 2 the key 40 illustrated there has been moved to a "locking" position of the key with the depending leg 50 in one of the recesses 18. It is noted that the end 52 of the key 40 is disposed outside of the block 30. In FIG. 2, if the slider 36 is moved to the left the very left end of it moves into the slot 41 in the adjacent block, leaving a slot into which the key 40 may be moved. In this regard, refer to the enlarged cross-sectional view of FIG. 5 in which it is noted that the key 40 has now moved into a slot 34 in the block 30. Furthermore note that the depending leg 50 is now out of the recess 18 and thus this particular key no longer prevents withdrawl of the shackle 12. There may, however, be other keys, that are still in their locked position and until all keys become unlocked the shackle will remain secured in the body.

Now, in the view of FIG. 1, it is noted that all of the keys are in their locked position (except the neutral keys). Because the blocks are not properly aligned with a key or because sliders are in the way, or because certain keys have not been moved yet to engage into a block, all of the selected keys are illustrated in FIG. 1 as being in their locked position. It is noted that some of the keys are also illustrated as being in their "neutral" position. In this regard, before the shackle 12 is inserted into the body, certain ones of the keys are selected to interengage with slots that are available while other ones of the keys are retained in their "neutral" position. Once the keys have been selected then the shackle is inserted. Thereafter, the device is locked by then moving all of the keys to their "locked" position as illustrated to the right in FIG. 2 and at the same time the blocks may then be moved and essentially "shuffled" so that most or perhaps all of the keys no longer align with slots in blocks. The task of the user is then to "reshuffle" the blocks as well as providing for the possible manipulation of sliders so that all keys can be inserted into a slot in a block to move to an unlocked position.

Figure 4:
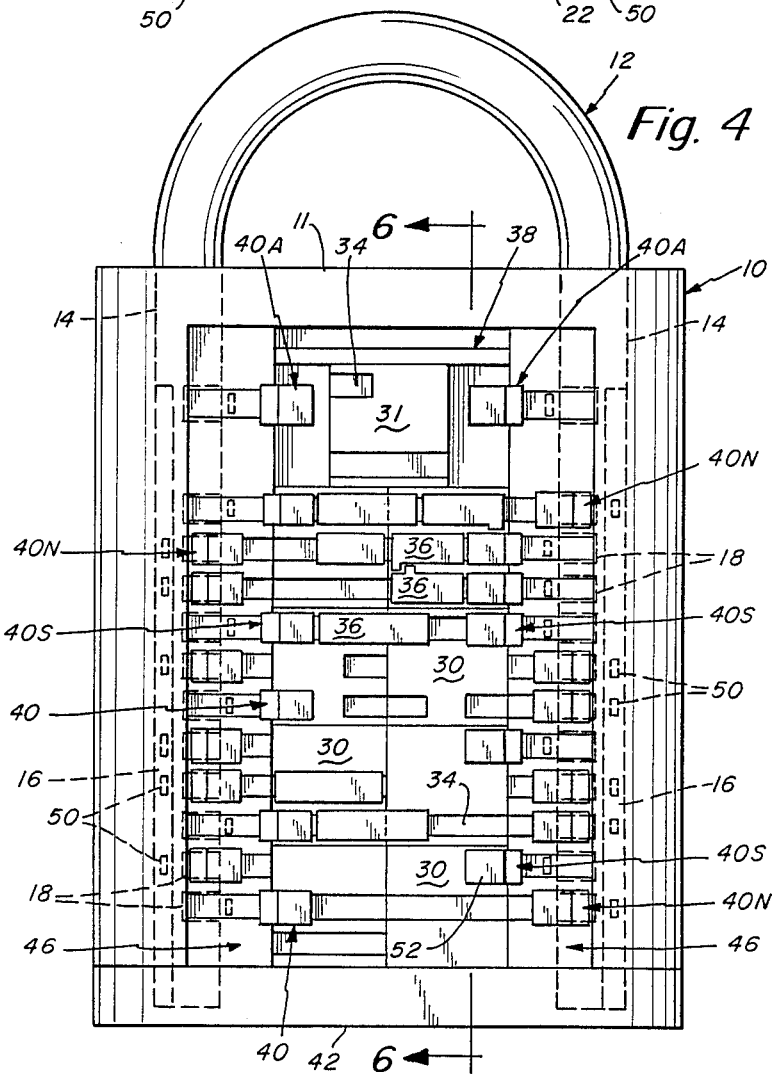
FIG. 4 is a plan view illustrating the puzzle lock in its unlocked position with all necessary keys inserted into corresponding blocks so that the shackle may be removed.

Now, reference is made to FIG. 4 for an illustration of the unlocked position. It is noted that any of the selected keys previously in the "locked" position have now been moved to the "unlocked" position. Some of the keys illustrated in FIG. 4 are still in their neutral position. Note for example neutral keys 40N in FIG. 4. Also note in FIG. 4 the selected keys identified in FIG. 4 as keys 40S. All of these keys have now been moved into an accmmodating slot in one of the blocks 30. This has been carried out by virtue of the user moving the blocks about the support carriage. For example, in connection with the position of FIG. 1, the top block 31 may be moved all the way to the right. The top block in the left hand column then has room to move up and actually all subsequent left hand blocks can then be moved up. Also, say two of the blocks may be moved up and this then leaves room for one of the right hand blocks to be moved to the left. This form of movement of the blocks is carried out until one can get to a position wherein there are blocks facing corresponding keys with the slots in the proper position so that the keys can move into the slots and thus unlock the device. Again, FIG. 4 illustrates this position in which all of the blocks have been moved to positions so that there are slots in alignment with the selected keys. This thus means that all of the depending legs from the keys are out of engagement with the corresponding recesses 18 so that both arms of the shackle are permitted to be withdrawn from the body. It is only when all of the selected keys can be moved to the "unlocked position" that the shackle can be removed.

FIG. 4 also illustrates two keys 40A which are safety keys. These keys must also be moved toward the top block 31 in the position illustrated in FIG. 4. This means that the top block 31 has to be toward the center (away from the right and left sides of the carriage) for the keys to be unlocked. This prevents the shifting up of other blocks to beat the necessary combination. If the safety keys 40A are not moved toward the block 31 then the shackle cannot be unlocked. Once they are moved towards the block 31 then this prevents the block 31 from being displaced to enable other blocks to be moved for alignment.

FIG. 6 is a cross-sectional view taken along line 6—6 of FIG. 4. This illustrates in the left hand block 30 the slot 34 in the block which does not align with any key because the corresponding position as illustrated in FIG. 4 is one of an unselected or neutral key. Adjacent to the slot 34 is the key 40 shown disposed in the slot in the block.

On the right hand side of FIG. 6 there is illustrated a slider 36 in one of the blocks and at block 31 there is illustrated the safety key 40A. It is noted that the key 40A is dimensioned so that it does not go into a slot in the block but instead can essentially be used as a stop.

Reference is now made to FIGS. 7–9 for an alternate embodiment of the combination block. In the previous views the block 30 has been illustrated as being essentially a solid block with slots. FIGS. 7–9 now illustrate a first embodiment of a rotatable block. The rotatable block varies the slot configuration and enhances the complexity of the game. FIG. 7 illustrates the block 60 in a plan view with the block shown in its normal position in solid outline and also shown in phantom rotated partially. This particular rotatable block construction can be rotated only at either end. FIG. 7 illustrates the block at the upper end of the block array. In this connection the carriage would have to be all the way down so that the block can slide up and turn. Note in FIG. 7 that there is just sufficient clearance for the block to rotate.

The block 60 that is illustrated is actually comprised of two parts including a base 62 and a top piece 64. The base 62 is provided with the interlocking bottom 65 and is furthermore provided with an elongated slot 66 as well as a U-shaped ridge 68.

The top piece 64 is provided with slots 70 as well as a support post 72 and opposed edge recesses 74.

As illustrated in FIG. 8, the support post 72 is adapted to fit in the slot 66 and thus the top piece 64 is capable of some sliding motion relative to the base 62. One or the other of the recesses 74 are adapted to engage with the ridge 68. In FIG. 8 it is noted that the ridge 68 is engaging with one of the recesses 74. The other recess 74 to the right in FIG. 8 is open.

In order to rotate the top piece 64, the top piece is slid from the position shown in solid outline in FIG. 8 to a position such as illustrated in phantom in FIG. 8. In this way the ridge 68 and the recess 74 disengage. It is noted that on the sides of the U-shaped recess 68, it extends only a small distance d as shown in FIG. 9 and thus once the top piece 64 has been slid sufficiently, the top piece may be rotated. As indicated previously, there is sufficient clearance because of the extra space provided as illustrated in FIG. 7 at 61. Once the top piece has been rotated through 180° then the opposite recess 74 now engages with the ridge 68 upon moving the top piece thereinto. The top piece then rests in its final position as indicated in solid outline in FIG. 8.

Figure 12:
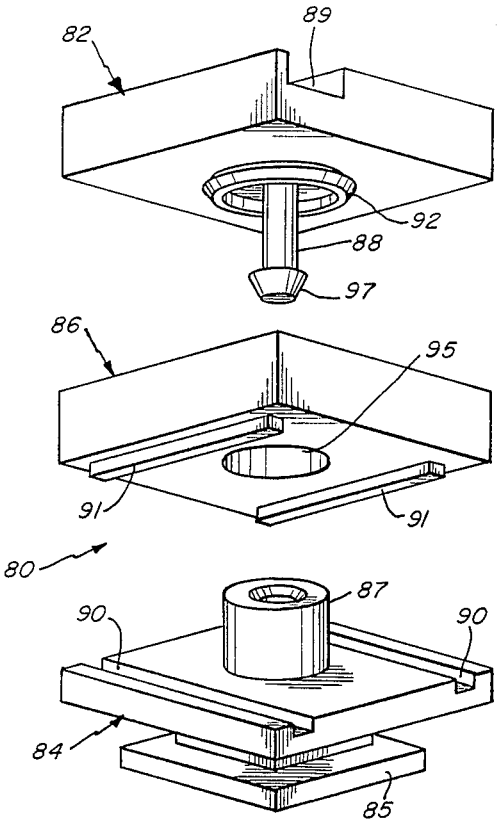
FIG. 12 is an exploded perspective view of the combination block in FIGS. 10 and 11.

Thus, in summary, in this first embodiment of a rotatable block, the top piece is not lifted relative to the base but instead it is slid relative to the base, rotated and then slid back to an interlocking position. In the second embodiment of a rotatable block described herein, the top piece is lifted and then rotated. The second embodiment to be described in FIGS. 10–12 is perhaps a preferred embodiment in that the rotatable block can be used at any position in the carriage. This is possible because once the top part of the block is lifted, it can be rotated freely because it then clears all adjacent blocks.

Reference is now made to FIGS. 10–12 for an illustration of the second embodiment of a rotatable block construction. The block 80 in this embodiment is comprised of three separate pieces including a top piece 82, a base 84 and an intermediate piece 86. The base 84 has the usual interlocking bottom 85 and also has a support post 87 adapted to receive the support pin 88 associated with the top piece 82. The top piece 82 is provided with one or more slots 89. The bottom piece is provided with opposed slots 90 that are adapted to engage with ridges 91 on the bottom of the intermediate piece 86. The slots 90 and ridges 91 cooperate to interlock the parts such as in the position of FIG. 10. In this embodiment of the invention the different parts of the block snap-fit together. Thus, as illustrated in FIGS. 10 and 11, the top piece 82 has a rim 92 that interlocks by a snap fit with an annular recess defined about the hole 95 in the intermediate piece 86. The support pin 88 extends downwardly through the hole 95. The pin 88 includes an end 97 that is also adapted to snap-fit with the support post 87. However, the pin 88 is free to move up and down in the hollow support post 87. FIG. 10 illustrates the block in its usual position. FIG. 11 illustrates the intermediate piece 86 and the top piece 82 having been lifted to enable rotation only of the top piece 82. The top piece 82 is free to rotate relative to the intermediate piece 86. The top piece 82 may be rotated through 180° or in an alternate embodiment slots could be provided in the four sides and the top piece 82 could be rotated though say 90°.

Having now described a limited number of embodiments of the present invention, it should now be apparent to those skilled in the art that numerous other embodiments and modifications thereof are contemplated as falling within the scope of the present invention.

What is claimed is:

1. An interlocking puzzle game comprising,
a body,
a locking member,
said body having means for receiving said locking member,
a plurality of combination blocks,
said body having means for receiving said blocks in a block array,
plurality of separate and manually operable keys,
said body having means for separately supporting said keys for individual sliding relationship in said body and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body.

2. An interlocking puzzle game comprising,
a body,
a locking member,
said body having means for receiving said locking member,
a plurality of combination blocks,
said body having means for receiving said blocks in a block array,
a plurality of keys,
said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
said locking member comprising a shackle having a pair of arms each with separate locking ribs.

3. An interlocking puzzle game as set forth in claim 2 wherein said body has spaced elongated passages for receiving said shackle arms.

4. An interlocking puzzle game as set forth in claim 3 wherein each key, in its locked position, engages with locking ribs.

5. An interlocking puzzle game as set forth in claim 4 wherein each arm also has an elongated recess with each key also having a neutral position in which it may be disposed and in which it engages said elongated recess.

6. An interlocking puzzle game as set forth in claim 1 wherein each block has a slot for receiving a key.

7. An interlocking puzzle game comprising,
a body,
a locking member,
said body having means for receiving said locking member,
a plurality of combination blocks,
said body having means for receiving said blocks in a block array,
a plurality of keys,
said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
each block having a slot for receiving a key,
each block having a plurality of slots for receiving plural keys.

8. An interlocking puzzle game as set forth in claim 6 including a slider disposed in the slot, said slider being shorter or the same in length as the length of the slot and may be disposed in different positions in the slot.

9. An interlocking puzzle game as set forth in claim 1 including a carriage for supporting the blocks in the body.

10. An interlocking puzzle game comprising,
a body,
a locking member,
said body having means for receiving said locking member,
a plurality of combination blocks, said body having means for receiving said blocks in a block array,
a plurality of keys,
said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
a carriage for supporting the blocks in the body,
the carriage having at least two alternate positions to provide different interengagement patterns between the blocks and keys.

11. An interlocking puzzle game comprising,
a body,
a locking member,
said body having means for receiving said locking member,
a plurality of combination blocks,
said body having means for receiving said blocks in a block array,
a plurality of keys,
said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
said means for receiving the blocks including means for supporting the blocks for sliding movement around the array so that different blocks may be slid to align with different keys.

12. An interlocking puzzle game as set forth in claim 11 wherein the array includes a void block-size space to enable block sliding.

13. An interlocking puzzle game as set forth in claim 12 wherein said keys include a pair of safety keys to prevent partial block sliding.

14. An interlocking puzzle game comprising,
a body,
a locking member,
said body having means for receiving said locking member,
a plurality of combination blocks,
said body having means for receiving said blocks in a block array,
a plurality of keys,
said body having means for supporting said keys in sliding relationship and adjacent said blocks,
at lease some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
at least one of said blocks being rotatable in the 15. An interlocking puzzle game as set forth in claim 14 wherein said block has a non-rotatable base and a rotatable top piece supported over the base.

16. An interlocking puzzle game as set forth in claim 15 wherein the top piece is capable of being rotatable through 180°.

17. An interlocking puzzle game as set forth in claim 15 wherein the block also has an intermediate piece and wherein the top piece is adapted for lifting relative to the base to enable rotation thereof.

18. An interlocking puzzle game as set forth in claim 15 wherein the top piece is mounted in the base enabling sliding relative to the base to in turn enable rotation relative to the base.

19. An interlocking puzzle game comprising,
a body,
a locking member,
said body having means for receiving said locking member, a plurality of combination blocks,
said body having means for receiving said blocks in a block array,
a plurality of keys, said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
each block having a slot for receiving a key and a slider disposed in the slot, adjacent sliders having interlocking means for controlling relative sliding between adjacent sliders.

20. A security apparatus comprising,
a body,
a locking member,
said body having means for receiving said locking member,
a plurality of combination blocks,
said body having means for receiving said blocks in a block array,
a plurality of keys,
said body having means for individually supporting said keys in sliding relationship adjacent said blocks and supported for separate manual selection on a key-by-key basis,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body.

21. A security apparatus comprising,
a body,
a locking member,
said body having means for receiving said locking member,
a plurality of combination blocks,
said body having means for receiving said blocks in a block array,
a plurality of keys,
said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
said locking member comprising a shackle having a pair of arms each with separate locking ribs.

22. A security apparatus comprising,
a body,
a locking member,
said body having means for receiving said locking member,
a plurality of combination blocks,
said body having means for receiving said blocks in a block array,
a plurality of keys,
said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
each block having a slot for receiving a key and a slider disposed in the slot.

23. A security apparatus as set forth in claim 20 including a carriage for supporting the blocks in the body.

24. A security apparatus as set forth in claim 20 wherein said means for receiving the blocks includes means for supporting the blocks for sliding movement around the array so that different blocks may be slid to align with different keys.

25. A security apparatus comprising,
a body,
a locking member,
said body having means for receiving said locking member,
a plurality of combination blocks,
said body having means for receiving said blocks in a block array,
a plurality of keys,
said body having means for supporting said keys in sliding relationship and adjacent said blocks,
at least some of said blocks having means for receiving a key,
each of said keys having at least a locked position and an unlocked position,
said key in the locked position engaging said locking member to prevent disengagement thereof from said body,
said key in the unlocked position being disposed in said block and out of engagement with the locking member to enable disengagement thereof from said body,
the top piece being capable of being rotatable through 180°.

26. A sliding puzzle game comprising a body, a locking member adapted to be engaged with the body, and a plurality of blocks adapted to be held in the body and to be arranged by relative movement thereof to enable unlocking of the locking member, a carriage for supporting the blocks in the body, said carriage having at least two alternate positions for changing block placement.

27. A sliding puzzle game comprising, a body, a locking member adapted to be engaged by the body and also having a disengaged position, a plurality of combination blocks, means for supporting these blocks in the body so that they can be moved to different positions therein and means responsive to a preselected position of said combination blocks for enabling disengagement of said locking member from said body, said means responsive to a preselected position including key means adapted to move into a slot in said block to satisfy said preselected position.

28. A sliding puzzle game as set forth in claim 27 wherein said locking member comprises a shackle having a pair of arms each with separate locking ribs.

29. A sliding puzzle game as set forth in claim 28 wherein said body has spaced elongated passages for receiving said shackle arms.

30. A sliding puzzle game as set forth in claim 29 wherein each key, in its locked position, engages with locking ribs.

31. A sliding puzzle game as set forth in claim 27 including a carriage for supporting the blocks in the body.

32. A sliding puzzle game as set forth in claim 31 wherein the carriage has at least two alternate positions to provide different interengagement patterns between the blocks and keys.

33. A sliding puzzle game as set forth in claim 27 wherein at least one of said blocks is rotatable in the body.

34. A sliding puzzle game comprising, a body, a locking member adapted to be engaged by the body and also having a disengaged position, a plurality of combination blocks, means for supporting said blocks in the body so that they can be moved to different positions therein, a plurality of separate and manually operable keys, said body having means for supporting said keys for individual sliding relationship in said body for engagement and disengagement with said blocks.

35. A sliding puzzle game comprising, a body, a locking member adapted to be engaged by the body and also having a disengaged position, a plurality of combination blocks, means for supporting said blocks in the body so that they can be moved to different positions wherein by sliding of said blocks, at least one of said blocks being rotatable in said body.

* * * * *